United States Patent [19]

Cymbler

[11] Patent Number: 4,537,405

[45] Date of Patent: Aug. 27, 1985

[54] AERIAL RECREATION DEVICE

[75] Inventor: Murray J. Cymbler, East Meadow, N.Y.

[73] Assignee: The Astro-Stream Corporation, East Meadow, N.Y.

[21] Appl. No.: 670,183

[22] Filed: Nov. 13, 1984

[51] Int. Cl.[3] ..... A63B 65/00

[52] U.S. Cl. ..... 273/428; 273/58 K

[58] Field of Search ..... 273/428, 58 K, 417, 273/420, 423

[56] References Cited

U.S. PATENT DOCUMENTS 801,145 10/1905 Feltner ..... 273/58 C
2,118,166 5/1938 Clark .
2,179,404 11/1939 Fabionar ..... 273/420
4,088,319 5/1978 Clarke ..... 273/428 X
4,113,251 9/1978 Imes, Jr. ..... 273/428 X
4,294,447 10/1981 Clark ..... 273/428 X

*Primary Examiner*—Paul E. Shapiro
*Attorney, Agent, or Firm*—Nolte, Nolte and Hunter

[57] ABSTRACT

An aerial recreation device having: a weighted head; at least two elongated flexible resilient arms, connected to the head, that extend laterally away from one another and from the longitudinal axis of the device and laterally beyond the head; and at least two, light and flexible, elongated tails connected to the arms. The device can be caught in flight by catching one of its arms or one of its tails which are located behind, but project laterally beyond, the head of the device in flight.

14 Claims, 5 Drawing Figures

AERIAL RECREATION DEVICE

BACKGROUND OF THE INVENTION

This invention relates to an aerial toy and, in particular, to a device especially adapted to be propelled as a projectile through the air for recreational purposes.

Recreational devices, designed to be propelled through the air, are well known in the art. See, for example, U.S. Pat. Nos. 2,087,445, 2,179,404, 2,338,274, 2,613,935, 3,393,911, 4,088,319, 4,113,251, 4,133,533, 4,248,424 and 4,294,447. Such devices frequently have included a weighted head connected to one or more, light and flexible, elongated tails and have been adapted to be propelled through the air by grasping the free end of the tail(s), swinging the head about the grasped free end of the tail(s) and then releasing the free end of the tail(s). See, for example, U.S. Pat. Nos. 2,179,404, 3,393,911, 4,088,319 and 4,294,447. However, it has generally been difficult to catch such a device, when it has been propelled through the air, except by catching its head. In this regard, it has generally been difficult to catch the tail(s) of such a device in flight because its tail(s) has extended behind its head where the tail(s) has been difficult to grasp as the device has flown toward an individual trying to catch it.

For this reason, an aerial recreation device has been sought which can be propelled through the air by grasping the free end of its tail(s), swinging its head about the grasped free end of its tail(s) and then releasing the free end of its tail(s) and which can be easily caught in flight by catching a part thereof besides its head.

SUMMARY OF THE INVENTION

In accordance with this invention, an aerial recreation device is provided which comprises:

a weighted head;

two or more, elongated flexible arms that are resilient when bent; each arm having a first end and a second end at its opposite ends; the first ends of the arms being connected to the head; the second ends of the arms extending laterally away from one another and from the longitudinal axis of the device and extending laterally beyond the head; and two or more, light and flexible, elongated tails; each tail having a first end and a second end at its opposite ends; the first end of each tail being connected to the second end of one of the arms; the arms and tails being adapted so that: (1) the second ends of the arms move laterally closer to one another and to the longitudinal axis of the device when the second ends of the tails are grasped together and the head is swung about the grasped second ends of the tails; and (2) the second ends of the arms move laterally apart, away from the longitudinal axis of the device and beyond the head, after the grasped second ends of the tails are released to propel the device through the air. This device can be caught in flight by catching one of its arms or one of its tails which project laterally beyond the head of the device in flight and which can, for this reason, be more easily caught than the tail(s) of one of the known aerial recreation devices. The arms of this device also keep the tails apart to prevent them from tangling and, in flight, create a pleasing visual effect by giving the device the appearance of width and the tails the appearance of synchronized flight.

DETAILED DESCRIPTION OF THE PREFERRED EMBODIMENT

Figure 2:
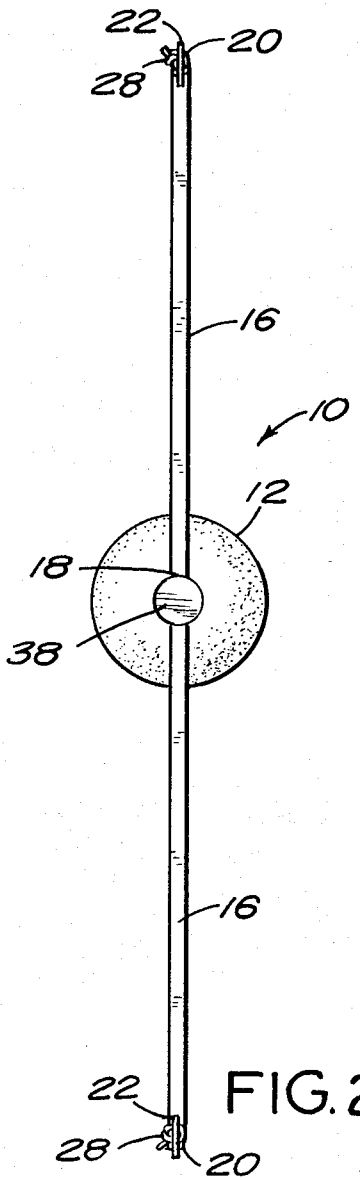
FIG. 2 is a schematic rear elevational view of the device of FIG. 1, taken from the right side of the device as shown in FIG. 1.
Figure 1:
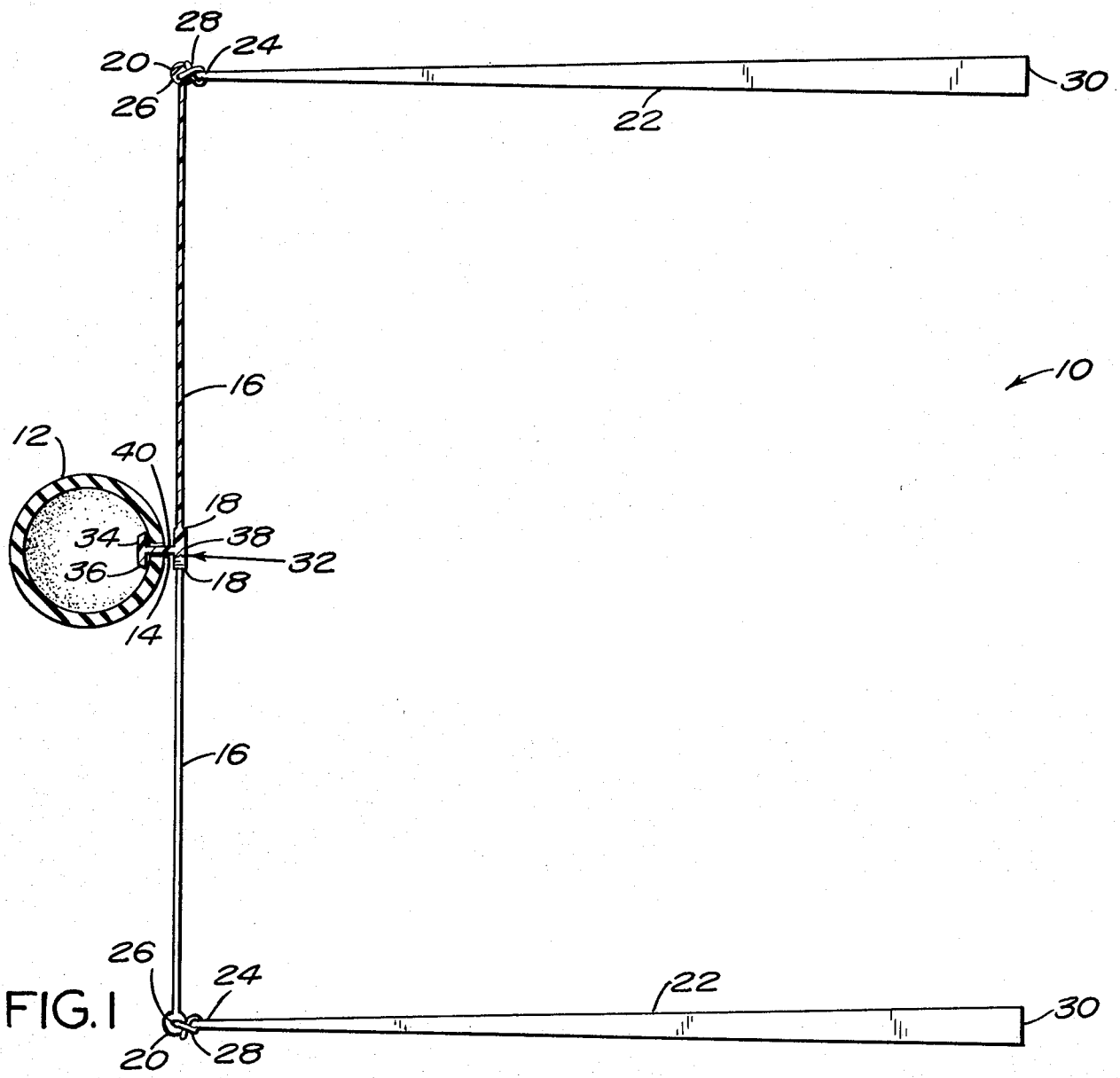
FIG. 1 is a schematic side elevation view of the aerial recreation device of this invention with the longitudinal axis of the device extending from left to right in FIG. 1; the head, one of the arms, and means for connecting the arms to the head have been shown in vertical section, taken through the longitudinal axis of the device.

FIGS. 1–4 show an aerial recreation device of this invention, generally 10. The device 10 has a weighted head, generally 12, with a generally ball-like configuration. As shown in FIG. 1, the head 12 preferably is a hollow self-supporting sphere with a hole 14 connecting the exterior and the hollow interior of the head 12. However, the head 12 can, if desired, have other than a ball-like configuration such as a generally conical configuration. The head 12 can be made of a conventional self-supporting rubber, a synthetic plastic material such as polyethylene or nylon, or a natural material such as leather. Preferably, the head 12 is made of a relatively soft material so that the risk of injury to an individual struck by the head 12 is minimized.

Figure 3:
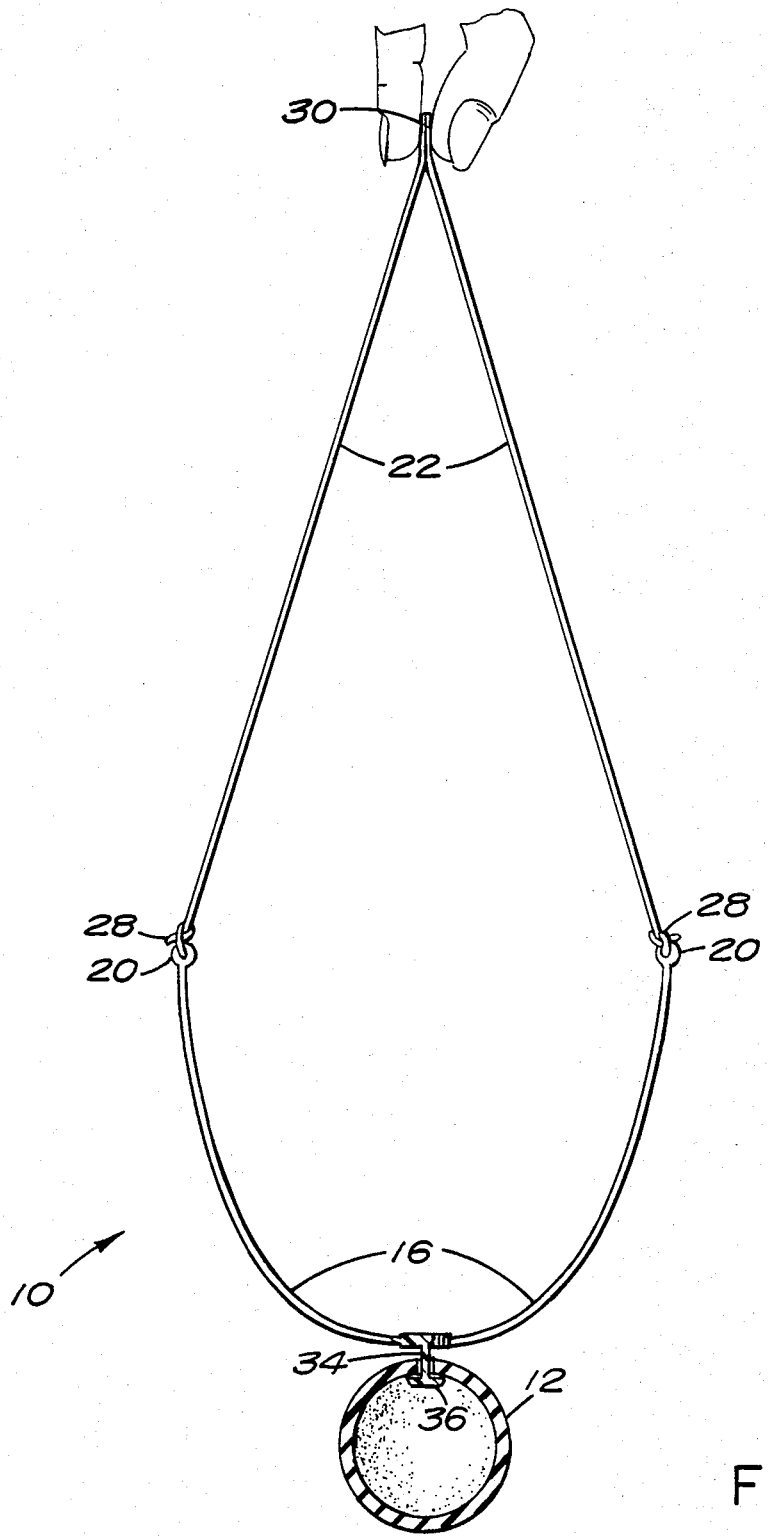
FIG. 3 is a schematic side elevation view of the device of FIG. 1 as it appears when grasped and held by the free ends of its tails with its head hanging downwardly; the head and means for connecting the head and arms have been shown in vertical section, taken through the longitudinal axis of the device.
Figure 4:
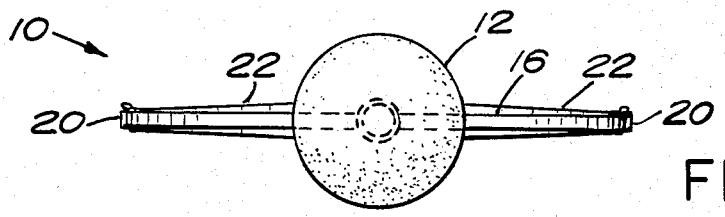
FIG. 4 is a bottom plan view of the device as shown in FIG. 3.

The device 10 also has a pair of thin elongated flexible straight arms 16. The arms 16 are resilient when bent and are preferably substantially self-supporting. The arms 16 are connected to the head 12 and preferably to each other at a first end 18 of each arm. As shown in FIG. 1, the first ends 18 of the arms 16 are located on opposite lateral sides of the longitudinal axis of the device. The arms 16 extend laterally in diametrically opposite directions away from the longitudinal axis of the device 10, so that an opposite second end 20 of each arm 16 is located laterally beyond the head 12. If desired, the device 10 can have more than two arms 16 connected at their first ends 18 to the head 12. However, such arms 16 should be spaced equidistantly about the longitudinal axis of the device and extend laterally away from each other and away from the longitudinal axis of the device and extend laterally beyond the head 12. In accordance with this invention, the arms 16 can be made from a conventional, flexible and resilient material, such as a plastic (e.g., nylon) which permits each arm 16: (a) to be bent from a substantially straight condition as shown in FIG. 1 to a curved condition as shown in FIG. 3 and (b) thereafter to become substantially straighter when the arm is no longer being subjected to bending forces.

The device 10 also has a pair of light and flexible, preferably non-resilient and non-self-supporting, elongated tails 22. A first end 24 of each tail 22 is connected to the second end 20 of one of the arms 16. The tails 22 can be ribbons made from a conventional material such as a natural or synthetic fabric of, for example, cotton, wool, rayon, nylon, polyester and/or polyethylene fibers or from a thin metal foil. If desired, more than one tail 22 can be attached to the second end 20 of each arm 16. Preferably, the total weight of the tails 22, together with the weight of the arms 16, is less than the weight of the head 12 to provide the device 10 with a truer flight trajectory.

The first end 24 of each tail 22 can be connected to the second end 20 of an arm 16 in any conventional manner. One way of connecting the tails 22 and arms 16, as shown in FIG. 1, is by providing a hole 26 in the second end 20 of each arm 16 and inserting the first end 24 of each tail 22 through the hole 26. The tails 22 can then be secured to the arms 16 by providing a knot 28 in the first end 24 of each tail. Opposite second ends 30 of the tails 22 are free ends and are kept substantially apart by the arms 16 to provide the device 10 with a novel and pleasing appearance in flight and to reduce the likelihood of the tails 22 tangling. In this regard, the tails 22, when in flight, are located laterally of the head 12 and substantially parallel to the longitudinal axis of the device 10. However, the second ends 30 of the tails 22 can be grasped together, as shown in FIG. 3, when the head 12 of the device 10 is to be swung about the grasped second ends 30 of the tails 22 in order to propel the device through the air.

The first ends 18 of the arms 16 can be connected to the head 12 in a conventional manner. Preferably, a one-piece member, generally 32, is provided for connecting the first ends 18 of the arms 16 to each other and to the head 12 at its hole 14 as shown in FIGS. 1 and 3. Such a connecting member 32 can comprise a longitudinally extending, elongated plug 34 that is preferably tapered at one end 36 for ease of insertion of the one end 36 into the hole 14 in the head 12. The other end 38 of the plug 34 is secured to the first end 18 of each arm 16. A recess 40 can be provided between the ends 36 and 38 of the plug 34, into which recess the portions of the head 12, about its hole 14, can be located to hold the end 36 of the plug within the head 12. Alternatively, the connecting member 32 can have a toggle (not shown) on one end that is inserted in the hole 14 to hold the one end of the connecting member 32 within the head 12 as disclosed in co-pending U.S. patent application, Ser. No. 613,483, filed May 24, 1984, entitled "METHOD AND APPARATUS FOR AERIAL RECREATION". The connecting member 32 can be made of metal or plastic. Preferably, the connecting member 32 and the arms 16 are made of the same plastic material and are formed as a single piece.

As shown in FIG. 3, the second end 30 of each tail 22 of the device 10 can be grasped, and then, the second ends 30 of the tails 22 can be held together to support the device with its head 12 hanging downwardly from the grasped second ends 30 of the tails 22. When the device 10 is put in such a position as shown in FIG. 3, its arms 16 are bent so that they become curved away from the head 12 as their second ends 20 move longitudinally away from the head 12 and laterally closer to one another and to the longitudinal axis of the device. The head 12 can then be swung about the grasped second ends 30 of the tails 22 in order to propel the device 10 through the air. When the head 12 is swung about the grasped second ends 30 of the tails 22, the arms 16 are bent further so that they become further curved away from the head 12 as their second ends 20 move longitudinally farther away from the head 12 and laterally still closer to one another and to the longitudinal axis of the device, preferably so that the connected end portions of each arm 16 and tail 22 are substantially colinear. When the second ends 30 of the tails 22 are subsequently released to propel the device 10 through the air, the arms 16 unbend so that they become substantially straighter as their second ends 20 move longitudinally toward the head 12, laterally away from each other and from the longitudinal axis of the device and laterally beyond the head 12 of the device. As a result, the device 10 can be caught in flight by grasping one of the arms 16 or tails 22 which are located behind, but project laterally beyond, the head 12 of the device in flight.

Figure 5:
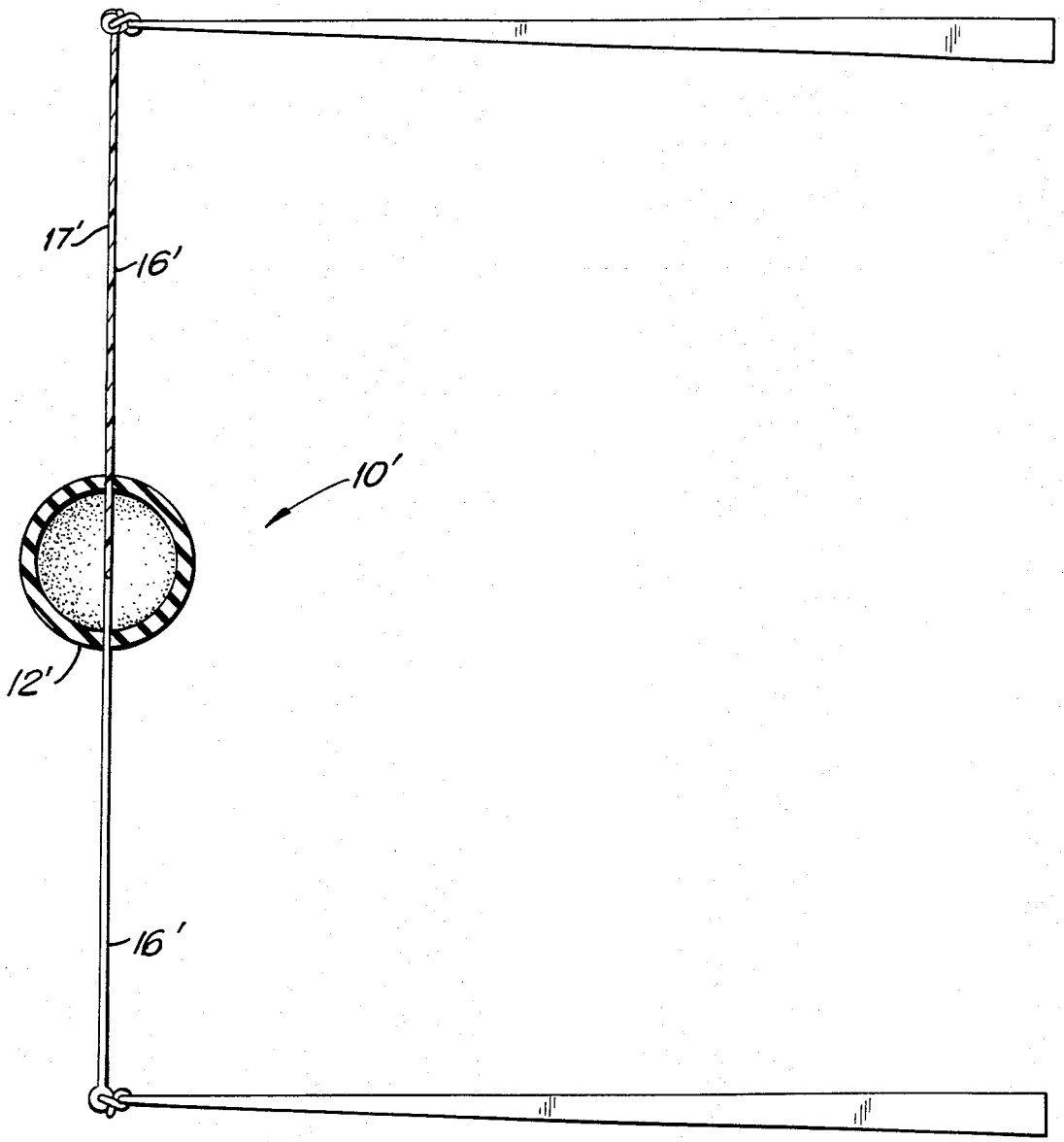
FIG. 5 is a schematic side elevation view, similar to FIG. 1, of an alternative embodiment of the aerial recreation device of this invention.

It is thought that the invention and many of its attendant advantages will be understood from the foregoing description of the aerial recreation device 10, and it will be apparent that various changes can be made in the invention and its method of operation without departing from the spirit and scope of the invention or sacrificing all of its material advantages, the device hereinbefore described being merely a preferred embodiment. For example, the arms 16 need not be straight and can be curved away from the head 12, even before the arms are bent when swinging the head about the grasped second ends 30 of the tails 22. The first ends 18 of the arms 16 also need not be connected to each other and can be connected directly to the head 12 at different points on the exterior of the head. For example, two or more arms 16' can be formed by a single elongated resilient flexible member 17' which extend through the head 12' at different points on the head of the aerial recreation device 10' of FIG. 5.

I claim:

1. An aerial recreation device, comprising:

a weighted head;

two or more, elongated, flexible arms that are resilient when bent; each arm having a first end and a second end at its opposite ends; the first ends of the arms being connected to the head; the second ends of the arms extending laterally away from one another and from the longitudinal axis of the device and extending laterally beyond the head; and two or more, light and flexible, elongated tails; each tail having a first end and a second end at its opposite ends; the first end of each tail being connected to the second end of one of the arms; the arms and tails being adapted so that: (1) the second ends of the arms move laterally closer to one another and to the longitudinal axis of the device when the second ends of the tails are grasped together and the head is swung about the grasped second ends of the tails; and (2) the second ends of the arms move laterally apart, away from the longitudinal axis of the device and beyond the head, after the grasped second ends of the tails are released to propel the device through the air.

2. The device of claim 1 wherein the device has only two arms, located on opposite lateral sides of the longitudinal axis of the device and extending laterally in diametrically opposite directions away from the longitudinal axis of the device.

3. The device of claim 2 wherein the arms are straight.

4. The device of claim 1 wherein the arms are spaced equidistantly about the longitudinal axis of the device.

5. The device of claim 1 wherein the head has a ball-like configuration.

6. The device of claim 5 wherein the head is a hollow self-supporting sphere.

7. The device of claim 6 wherein a hole in the head connects its exterior and hollow interior.

8. The device of claim 7 wherein the first ends of the arms are secured to one end of an elongated one-piece member, the other end of the one-piece member being inserted in the hole in the head.

9. The device of claim 8 wherein the other end of the one-piece member is tapered and a recess is provided between the ends of the one-piece member; and portions of the head, about its hole, are located in the recess to hold the other end of the one-piece member within the head.

10. The device of claim 9 wherein the arms and the one-piece member comprise a single piece.

11. The device of claim 1 wherein the arms are substantially self-supporting.

12. The device of claim 1 wherein the first ends of the arms are connected to each other.

13. The device of claim 1 wherein the arms are connected to the head at different points on the exterior of the head.

14. The device of claim 13 wherein the device has two or more arms formed by a single elongated resilient flexible member extending through the head at different points on the head.

* * * * *